US005816993A

United States Patent [19]

Fowler et al.

[11] Patent Number: 5,816,993

[45] Date of Patent: Oct. 6, 1998

[54] APPARATUS AND METHOD FOR ATTACHING CARRYING HANDLES TO BAGS

[75] Inventors: Maxie Joe Fowler; William Belmont Osteen, both of Hodge, La.

[73] Assignee: Stone Container Corporation, Chicago, Ill.

[21] Appl. No.: 589,775

[22] Filed: Jan. 22, 1996

[51] Int. Cl.[6] ..... B31B 1/86; B65D 25/28

[52] U.S. Cl. ..... 493/226; 493/221; 493/399; 493/926

[58] Field of Search ..... 493/226, 88, 115, 493/131, 210, 212, 221, 256, 344, 909, 926, 397, 399, 436, 438, 446, 31, 380, 381, 388, 271, 276

[56] References Cited

U.S. PATENT DOCUMENTS

| | | | |
|---|---|---|---|
| 3,034,409 | 5/1962 | Finke | 493/926 |
| 3,101,033 | 8/1963 | Bonsor | 493/221 |
| 3,202,064 | 8/1965 | Kennedy | 493/226 |
| 3,334,550 | 8/1967 | Craig | 493/221 |
| 3,424,067 | 1/1969 | Blair | 493/334 |
| 3,590,696 | 7/1971 | Reissner | 493/226 |
| 3,613,923 | 10/1971 | Wesselman | 493/221 |
| 3,722,377 | 3/1973 | Hayes | 493/221 |
| 3,773,591 | 11/1973 | Blair | 493/926 |
| 4,133,252 | 1/1979 | Eckstein | 493/226 |
| 4,861,170 | 8/1989 | Patriksson | 493/226 |
| 5,298,007 | 3/1994 | Achelpohl | 493/226 |
| 5,356,221 | 10/1994 | Achelpohl | 493/226 |
| 5,609,556 | 3/1997 | Rostalski | 493/226 |

FOREIGN PATENT DOCUMENTS

| | | | |
|---|---|---|---|
| 4 303 951 | 4/1994 | Germany | 493/221 |

OTHER PUBLICATIONS

H.G. Weber and Company brochure, dating from at least as early as Jan. 21, 1995, directed to bag handle fabricating and applying machinery, 3 pages.

*Primary Examiner*—Joseph J. Hail, III
*Assistant Examiner*—Christopher W. Day
*Attorney, Agent, or Firm*—Dick and Harris

[57] ABSTRACT

An apparatus and a method for attaching at least one carrying handle to a bag, such as a shopping bag, grocery bag, or the like. Individual handles are severed from a continuous web of handle material. Bags are conveyed at a predetermined velocity, with a longitudinal axis of each bag substantially perpendicular to the bag's direction of travel. Each carrying handle is transported proximate a front or back surface of an associated bag, and in a direction of travel wherein a longitudinal axis of the carrying handle is substantially parallel to the direction of travel of the bag, and substantially perpendicular to the longitudinal axis of the bag. The handle is transported at a velocity substantially equal to the predetermined velocity of the bag. The handle is applied to the bag when a handle accepting region of the bag contacts an attachment panel portion of the carrying handle.

19 Claims, 7 Drawing Sheets

10
20
21
22
30
23
24
25
25
35
40
60
61
100
40
25
25
40
50
25

APPARATUS AND METHOD FOR ATTACHING CARRYING HANDLES TO BAGS

BACKGROUND OF THE INVENTION

The present invention relates, in general, to the manufacture of bags, and, more particularly, to an apparatus and a method for attaching carrying handles to bags.

Handled bags, such as handled paper grocery and shopping bags, have remained popular, even with the advent and rise in popularity of all-plastic grocery bags. Indeed, handled paper grocery bags appear to have remained popular, at least in part, due to their strength, their relatively large carrying capacity, and their ability to substantially retain a rectangular shape, regardless of how few or how many articles are placed within the bag.

Apparatuses for manufacturing handled bags have been known in the art for some time. One example of such an apparatus is Gaffney, U.S. Pat. No. 3,865,018. In this patent, an apparatus is disclosed wherein separate handles are attached to portions of a web of material from which individual bags are subsequently cut and formed. Moreover, in this reference, a continuous web of handle material is supplied, and is fed towards the web of bag material, in a direction which is perpendicular to the direction of the travel of the web from which the bag will be formed. In such devices, individual handles, which are severed from the web of handle material and attached to the individual bags or the web of bag material, must be rapidly tacked to the moving bag, and must rapidly change their direction of movement following attachment to the bag by 90°, in order to be firmly attached in a proper orientation relative to each individual bag. This perpendicular orientation of the supply of handles, relative to the direction of travel of the web of bag material, accordingly provides for a relatively difficult attachment of the handle, due to the necessity of applying the handle to a bag moving in a perpendicular direction relative to the travel of the handle. Alternatively, in such devices, the web of bag material must be momentarily slowed or stopped, decreasing through-put in order to facilitate the attachment of the individual handles.

Accordingly, it is an object of the present invention to provide an apparatus and a method for the relatively high-speed attaching of handles to bags.

It is another object of the present invention to provide an apparatus and a method for attaching handles to bags, wherein, prior to attachment, each handle is transported in a direction of travel which is substantially parallel to the direction of travel of an associated bag.

These and other objects, features, and modes of operation of the present invention will become apparent in light of the present specification, claims and drawings.

SUMMARY OF THE INVENTION

The present invention comprises an apparatus for attaching at least one carrying handle to a bag. The bag has a front panel, a back panel, a bottom end and a top end having an opening into an interior region of the bag. The bag further includes a longitudinal axis intersecting the top and bottom ends of the bag. The carrying handle has an elongated attachment panel portion, a longitudinal axis extending along the elongated attachment panel portion, and a grasping portion coupled to the attachment panel portion.

Means are provided for conveying the bag at a predetermined velocity, and with the longitudinal axis of the bag substantially perpendicular to a direction of travel of the bag. Means are further provided for transporting the carrying handle proximate at least one of the front and back panels of the bag, and in a direction of travel wherein the longitudinal axis of the carrying handle is substantially perpendicular to the longitudinal axis of the bag, at a velocity substantially equal to the predetermined velocity of the bag. Means are also provided for attaching the carrying handle to a handle accepting region of the bag. These attachment means may comprise, for example, means for depositing an adhesive upon at least one of the elongated attachment panel portion of the carrying handle and a handle accepting region of the bag.

In this manner, at least one handle is applied to a front or back panel of the bag, when the bag is transported by the conveying means to a position where the handle accepting region of the bag contacts the attachment panel portion of the carrying handle. Accordingly, the carrying handle is affixed to the bag with its attachment panel portion attached to and juxtaposed over the handle accepting region of the bag.

In a preferred embodiment, the means for transporting the carrying handle includes at least one drum member. The drum member has an axis of rotation which is substantially perpendicular to the direction of travel of the bag. Moreover, the drum member has an outer surface proximate at least a portion of an upper surface or a lower surface of the conveying means. Further, the drum member includes means for releasably transporting a carrying handle substantially adjacent its outer surface, at a tangential velocity which is substantially equal to the predetermined velocity of the bag.

Also, in a preferred embodiment, a continuous web, or ribbon of carrying handles is provided, with each of the handles being substantially collinear to each other along the continuous web. The continuous web includes a leading edge, which is applied to and releasably transported by the drum member. Means are further provided, in a preferred embodiment, for cutting the continuous web of handles into individual handles. The handle cutting means is preferably operably attached to the outer surface of the drum member.

Moreover, in a preferred embodiment, the means for releasably transporting the carrying handle substantially adjacent the outer surface of the drum member includes at least one aperture extending through and rotating with the outer surface of the drum member. The aperture communicates with a source of vacuum pressure, which serves to draw air through the aperture to, in turn, transiently affix a portion of the carrying handle overlying the aperture to the outer surface of the drum member. The source of vacuum pressure is preferably fixed in position relative to the rotation of the drum member, and is applied proximate the drum member and limited to only a portion of the drum member's circumference, such that as the drum member rotates, vacuum pressure is alternatingly applied to and removed from the aperture. In this manner, the portion of the carrying handle overlying the aperture is releasably affixed to the outer surface of the drum member only when the aperture is exposed to vacuum pressure.

Also, in a preferred embodiment, means are provided for enhancing the attachment of the carrying handle to the bag by compressing the carrying handle and the bag towards each other. The attachment enhancing means preferably includes a plurality of pinch rollers. The conveying means transport a portion of the bag between the pinch rollers, such that a portion of the handle accepting region of the bag and the attachment panel portion of the handle are momentarily disposed between the pinch rollers.

Means are preferably further provided for folding the grasping portion of the handle towards the attachment panel portion of the handle, following attachment of the handle to the bag. These folding means preferably include means for scoring the handle, so as to form a longitudinal score line, and means for moving the grasping portion towards the attachment panel portion, such that the handle is folded proximate the longitudinal score line.

In a preferred embodiment, two carrying handles are provided, including a first carrying handle and a second carrying handle. Means are provided for transporting both the first and second carrying handles proximate the front and back panels of the bag, respectively. Means are further provided for depositing adhesive upon at least one of the attachment panel portion of the first handle and a first handle accepting region of the front panel. Means are similarly provided for depositing additional adhesive upon at least one of the attachment panel portion of the second carrying handle and a second handle accepting region of the back panel of the bag. In this manner, the first carrying handle is applied to the front panel of the bag and the second carrying handle is applied to the back panel of the bag, when the bag is transported by the conveying means to a position where the first and second handle accepting regions of the bag contact respective attachment panel portions of the first and second carrying handles. The first and second carrying handles are accordingly applied to opposing panels of the bag, with their respective attachment panel portions attached to and juxtaposed over corresponding handle accepting regions of the bag.

Moreover, in a preferred embodiment, a supply of a continuous web of handle material is provided. Means are provided for receiving the continuous web, and for cutting the web into at least two continuous ribbons of handles, including a first ribbon of handles and a second ribbon of handles. The first ribbon of handles is subsequently severed into individual handles and applied to the front panel of the bag. The second ribbon of handles is subsequently severed into individual handles and applied to the back panel of the bag.

The present invention also comprises a method for attaching at least one carrying handle to a bag. The method of the present invention comprises the steps of: 1) providing a bag having a front panel, a back panel, a bottom end, and a top end having an opening into an interior region of the bag, and a longitudinal axis intersecting the top and bottom ends of the bag; 2) providing a carrying handle having an elongated attachment panel portion, a longitudinal axis extending along the attachment panel portion, and a grasping portion coupled to the attachment panel portion; 3) transporting the bag along a conveyor having an upper surface and a lower surface, at a predetermined velocity and with the longitudinal axis of the bag substantially perpendicular to a direction of travel of the bag; 4) transporting the carrying handle proximate at least one of the front and back panels of the bag, and in a direction of travel wherein the longitudinal axis of the carrying handle is substantially perpendicular to the longitudinal axis of the bag, at a velocity substantially equal to the predetermined velocity of the bag; 5) applying the carrying handle to one of the front and back panels of the bag when the bag is transported by the conveyor to a position wherein the handle accepting region of the bag contacts the attachment panel portion of the carrying handle; and 6) attaching the carrying handle to the bag with its attachment panel portion attached to and juxtaposed over the handle accepting region of the bag.

The present invention also comprises an apparatus for attaching at least one carrying handle to a continuous web of material from which individual handled bags are subsequently formed. Each subsequently formed bag has a front panel, a back panel, a bottom end, a top end having an opening into an interior region of the bag, and a longitudinal axis intersecting the top and bottom ends of the bag. Means are provided for conveying the continuous web of bag material at a predetermined velocity, and with the longitudinal axis of each subsequently formed bags being substantially perpendicular to the direction of travel of the continuous web.

Means are also provided for transporting the carrying handles proximate a portion of the continuous web corresponding to at least one of the front and back panels of the subsequently formed bag, in a direction of travel wherein the longitudinal axis of the carrying handle is substantially parallel to the direction of travel of the continuous web, and substantially perpendicular to the longitudinal axis of the subsequently formed bag, at a velocity substantially equal to the predetermined velocity of the continuous web.

Means are further provided for attaching the carrying handle to a portion of the continuous web corresponding to an attachment panel portion of the bag. In this manner, the carrying handle is applied to the portion of the continuous web corresponding to the front or back panel of the subsequently formed bag when the continuous web is transported by the conveying mens to a position wherein the portion of the continuous web corresponding to the handle accepting region of the subsequently formed bag contacts the attachment panel portion of the carrying handle. As a result, the carrying handle is affixed to the continuous web with its attachment panel portion attached to and juxtaposed over the portion of the web corresponding to the handle accepting region of the subsequently formed bag.

DETAILED DESCRIPTION OF THE DRAWINGS

Figure 1:
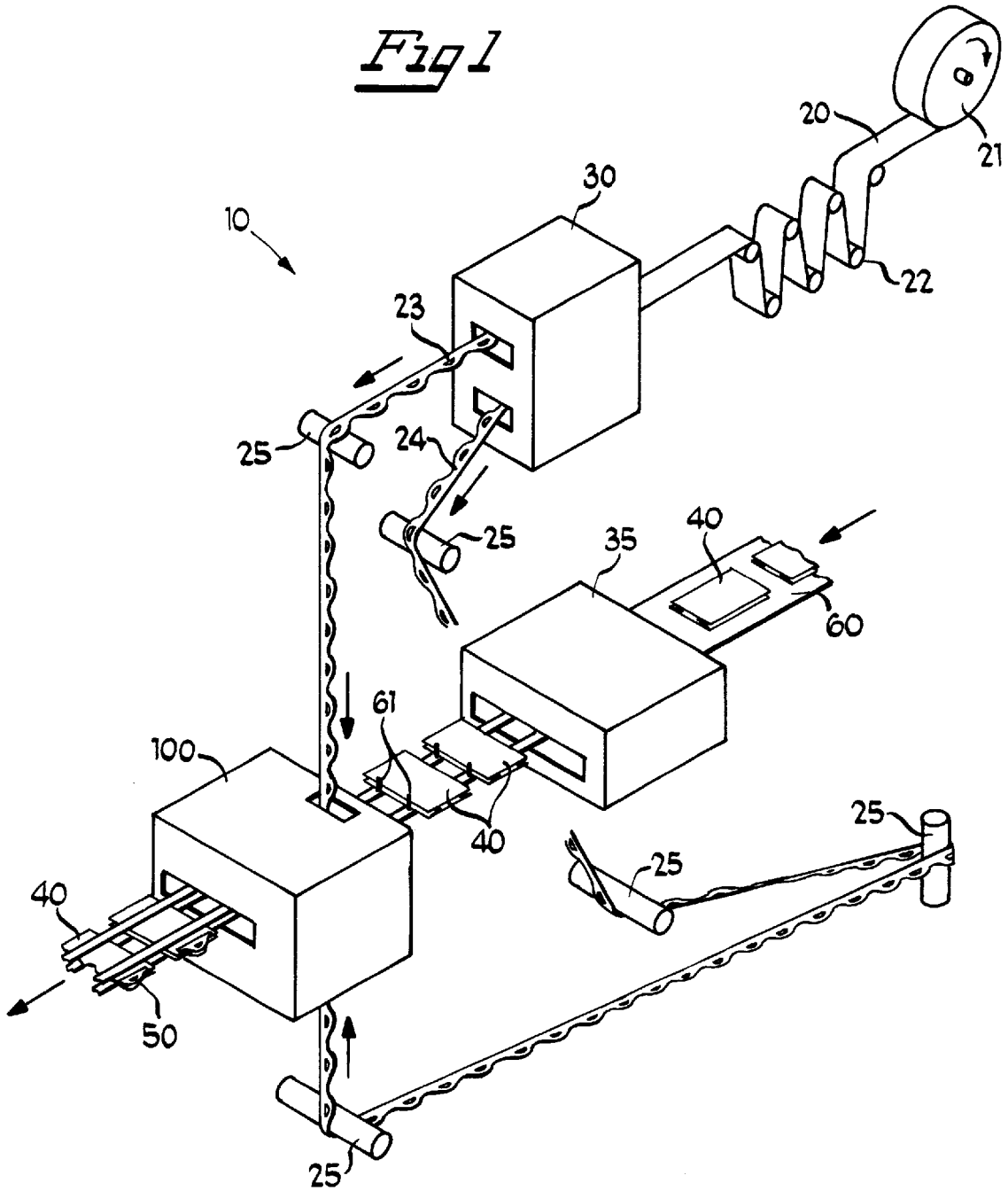
FIG. 1 of the drawings is a perspective view of a portion of a bag manufacturing apparatus including the present handle applicator apparatus.

While the present invention is susceptible of embodiment in many different forms, there is shown in the drawings and will herein be described in detail, several specific embodiments, with the understanding that the present disclosure is to be considered an exemplification of the principles of the present invention, and is not intended to limit the invention to the embodiments illustrated.

A portion of an overall bag manufacturing apparatus 10 which includes the present handle applicator 100 is shown in FIG. 1 as including a supply 21 of a web of handle material 20, die cutter 30, conveying means including conveyor 60 transporting bags 40, bag turning apparatus 35, and handle applicator 100.

Bag turning apparatus may comprise, for example, the particular apparatus disclosed in copending U.S. patent application Ser. No. 08/546,082, filed Oct. 20, 1995 and assigned to the same assignee as the present invention.

Handle material 20 is preferably a plastic or other flexible material, and may, for example, comprise a mixture of linear low density and fractional mil polyethylene, with coloring and additional additives, having a thickness of approximately 7.5 mil. Other suitable, flexible materials may alternatively be used.

As used herein, "continuous web" refers to a sheet of material having a substantial length. A continuous web of handle material 20 is stored as roll 21, and unwound as the handle material is used in the manufacturing process. A plurality of rollers 22 maintain tension on the web, as handle material 20 is fed to die cutter 30. Die cutter 30 continuously cuts the web of handle material 20 into two separate webs, or ribbons of handles, 22 and 23, respectively. Die cutter 30 may comprise a conventional "off the shelf" component, such as those manufactured by the Integrated Design Corporation of Green Bay, Wis. A plurality of rollers 25 transport the two ribbons of handles 23, 24 from die cutter 30 to handle applicator 100, wherein they are severed into individual handles 50, and then applied to front and back panels, respectively, of corresponding bags 40. As shown in FIG. 1, ribbon 24 is turned, or twisted, as it is fed to handle applicator 100, such that grasping portions of both ribbons 23 and 24 are substantially aligned prior to the application of the handles to associated bags.

Figure 9:
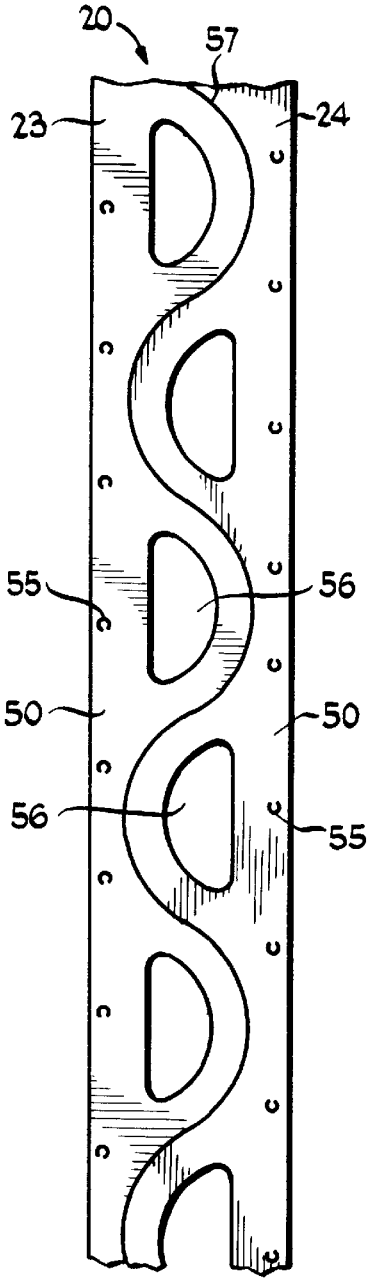
FIG. 9 of the drawings is a top plan view of a portion of a continuous web of handle material, showing, in particular, the cutting of the web into two continuous ribbons of handles.

The cutting pattern applied to the web of handle material 20 by die cutter 30 is shown in FIG. 9. A substantially sinusoidal-shaped cut 57 is continuously made along the length of handle material 20, in order to separate the web into two separate ribbons 23, 24 of handle material. A plurality of regularly-spaced annular cuts are made proximate the side edges of handle material 20, in order to form a plurality of sprocket holes 55. Each sprocket hole preferably comprises a through-cut of approximately ⅔ of the circumference of a circle, leaving a small tab of material to later close the sprocket hole upon attachment of individual handles to associated bags. This sealing of the sprocket holes serves to reduce leakage of adhesive therethrough during the handle application process. Moreover, the tab is preferably left in an orientation corresponding to a direction of pull, or tension imparted by sprocket teeth disposed upon wheels directing the travel of the ribbons of handle material, so as to provide a certain degree of additional strength, or reinforcement of the sprocket holes. Die cutter 30 further creates a plurality of handle apertures 56, along the length of each ribbon of handle material.

Figure 3:
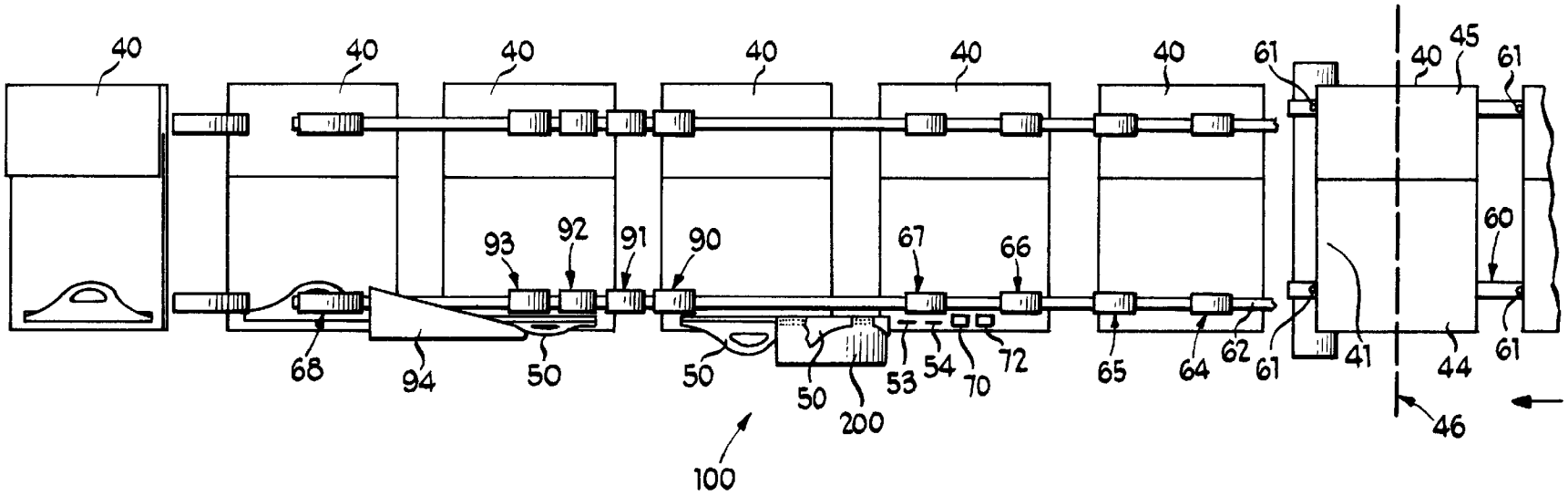
FIG. 3 of the drawings is a top plan view of the handle applicator apparatus of FIG. 2.

As best seen in FIG. 3, each bag 40 is transported by conveyor 60 in a "sideways" orientation. Bag 40 includes top end 44, bottom end 45, and a longitudinal axis 46 (one of which is shown) intersecting the top and bottom ends. As shown in FIG. 3, each bag 40 is transported along conveyor 60 with longitudinal axis 46 substantially perpendicular to the bag's direction of travel, and with top end 44 and bottom end 45 of the bag facing opposing side edges of conveyor 60. Front panel 41 of bag 40 faces upwards, while an opposing back panel 42 (FIG. 8A) rests upon the upper surface of conveyor 60.

Each bag 40 is preferably constructed from a paper material of approximately 25 to 100 pound thickness, such as 60–75 pound material. In the illustrated embodiment, each collapsed bag is substantially rectangular, is approximately 11.5 inches in width, and approximately 16.5 inches in length. Other suitable materials, and other suitable bag sizes and configurations, may alternatively be used.

Figure 8A:
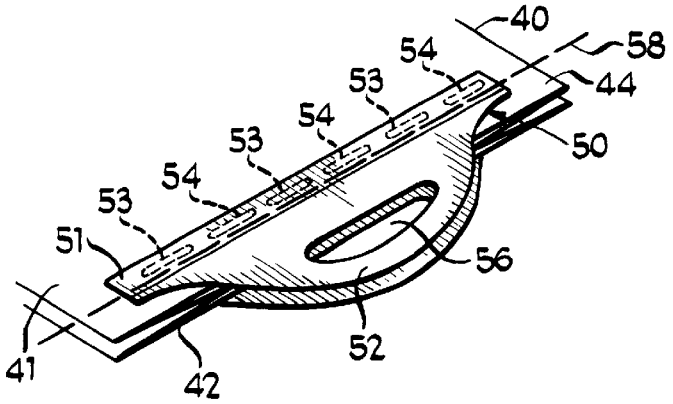
FIG. 8A of the drawings is a perspective view of a portion of a bag, showing, in particular, the attachment of a handle using alternating regions of hot melt and cold resin adhesives.
Figure 8B:
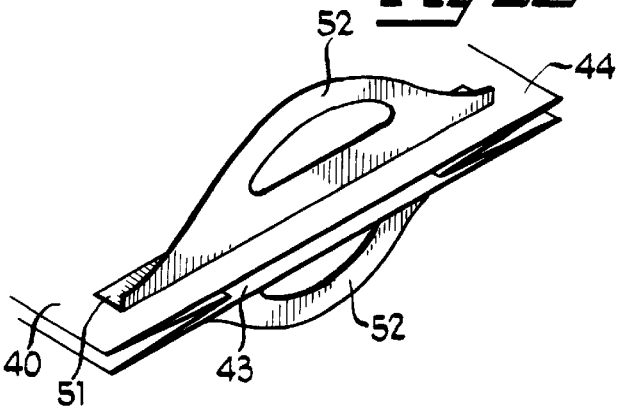
FIG. 8B of the drawings is a perspective view of the portion of the bag of FIG. 8A, showing, in particular, the partial folding of the grasping portion of the handle along a score line.
Figure 8C:
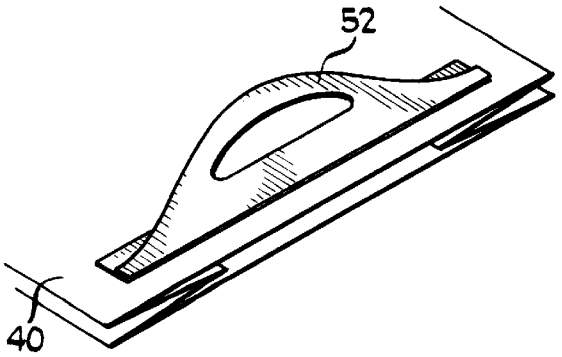
FIG. 8C of the drawings is a perspective view of the portion of the bag of FIGS. 8A and 8B, showing, in particular, a completely folded carrying handle attached to the bag.

The attachment of carrying handles to bags, and the subsequent folding of the carrying handles, is shown in FIGS. 8A–8C. As shown in FIG. 8A, two handles are applied to each bag 40; a first handle is applied to front panel 41 of the bag, and a second handle is simultaneously applied to back panel 42 of the bag. Each handle 50 includes elongated attachment panel portion 51, a longitudinal axis 58 extending along attachment panel portion 51, grasping portion 52 coupled to attachment panel 51, and handle aperture 56, to facilitate gripping of handle 50. Each handle 50 is attached to a corresponding handle accepting region of the front or back panel of bag 40, proximate opening 43 into the interior region of bag 40.

In a preferred embodiment, both hot melt and cold resin adhesives are employed in attaching each handle 50 to a corresponding bag 40. The hot melt adhesive serves to provide a relatively rapid seal, in order to hold handle 50 firmly attached to bag 40 during the subsequent handle scoring and folding processes. The cold resin adhesive typically provides a stronger overall adhesion, but requires additional time to cure, as compared to the hot melt adhesive. The cold resin adhesive is further believed to provide improved performance, as compared to hot melt adhesive, over a range of environmental temperature extremes to which bag 40 may be exposed in the field. The hot melt adhesive may comprise, for example, a wax-based adhesive such as HM587 type adhesive, manufactured by Port City Adhesives of Wilmington, N.C. The cold resin adhesive may comprise, for example, a polyvinyl acetate type adhesive, such as HM587 type adhesive, also manufactured by Port City Adhesives. As shown in FIG. 8A, substantially collinear regions of hot melt adhesive 53 and cold resin adhesive 54 are applied to both the front and back panels of bag 40, in an alternating sequence or pattern, and within the handle accepting region of the front and back panels. Carrying handles 50 are then simultaneously applied to the front and back panels of bag 40, such that their respective attachment panels abut, and are juxtaposed over, corresponding handle accepting regions of bag 40.

Next, as shown in FIGS. 8B and 8C, each handle 50 is folded, so as to facilitate the storage of bag 40 within a relatively small overall area, for facilitating shipping of bags 40 in quantity. Both handles are scored along their respective lengths, proximate the junction of their respective grasping portions 52 and attachment panel portions 51. Next, each handle is folded proximate the score line, with grasping portion 52 of each handle brought into close proximity of a corresponding panel of bag 40. The folding of the carrying handles not only provides for a more compact bag profile for facilitating packaging, shipping and storage, but also facilitates the manual filling of bags with articles, inasmuch as the handles are folded well out of the way of the opening into the interior of the bag.

Figure 2:
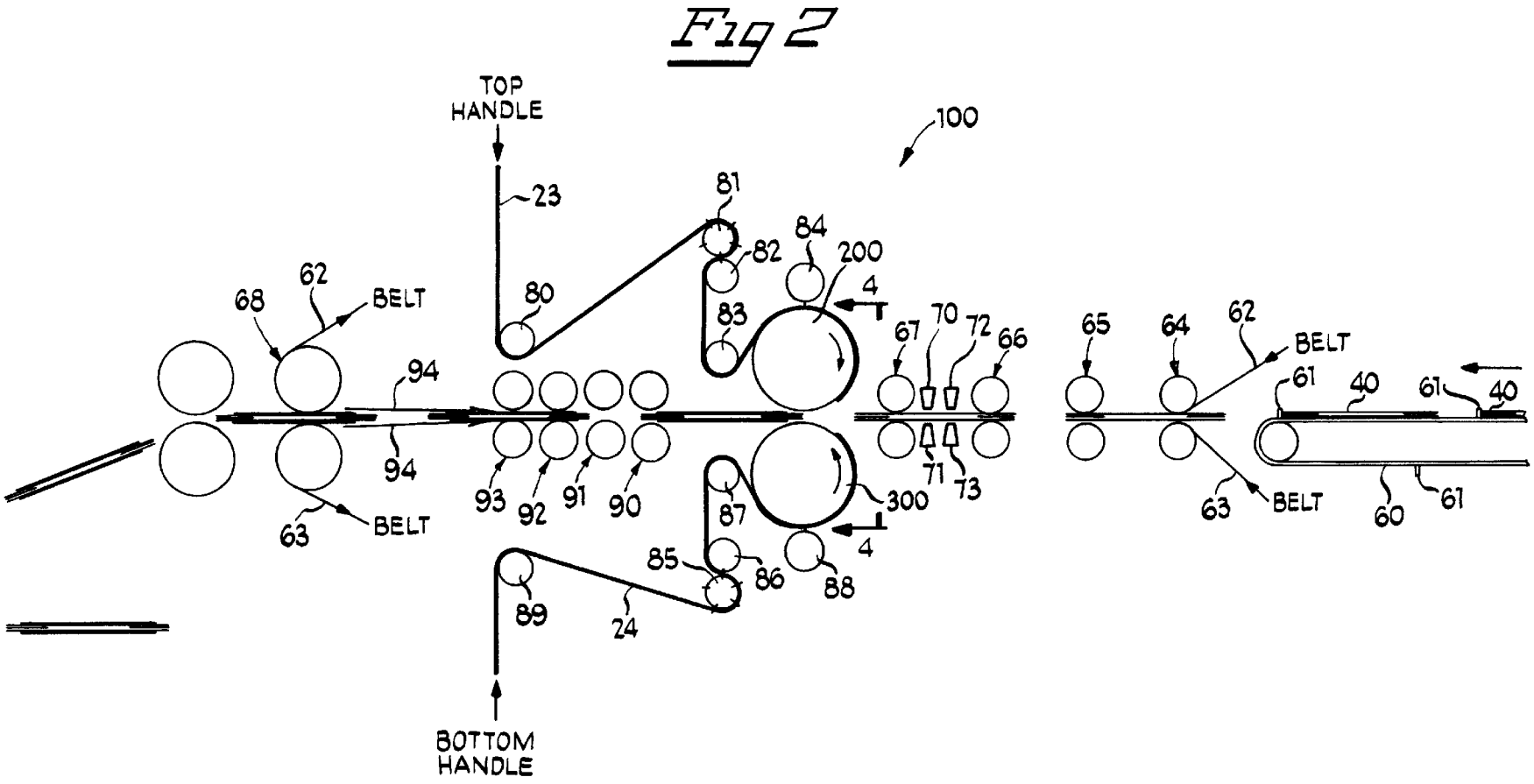
FIG. 2 of the drawings is a side elevation of the handle applicator apparatus.

As shown in FIGS. 2 and 3, conveyor 60 includes a lug belt, having a plurality of regularly-spaced lugs 61. Each bag 40 is carried by the lug belt with a leading side edge of the bag abutting a corresponding pair of lugs 61. In this manner, bags 40 are transported by the lug belt in a regularly-spaced manner, with the leading edges of successive bags spaced approximately 17 inches apart, and at an overall predetermined velocity of approximately 400 bags per minute. As each bag travels along conveyor 60 from right to left as viewed in FIGS. 2–3, it is removed from the lug belt upon reaching counter-rotating pairs of nip rollers 64, 65, 66 and 67. At this time, each bag 40 is secured between belts 62 and 63, driven by the nip rollers. Moreover, at this time, the speed of each bag is slightly reduced, inasmuch as rollers 64, 65, 66 and 67 continue to feed bags at a rate of 400 bags per minute, but at a separation of 15 inches, rather than 17 inches, between leading edges of successive bags 40. The nip rollers, together with belts 62 and 63, accordingly provide further means for conveying bags 40 at a predetermined velocity.

As each bag is driven from rollers 66 to 67, adhesives are simultaneously deposited upon handle accepting regions of both the front and back panels of each bag 40, as best seen in FIG. 3. As best seen in FIG. 2, a pair of coaxial spray nozzles 70, 71 are employed to deposit pressurized hot melt adhesive 53 upon the front and back panels of each bag 40, respectively. Moreover, a second pair of coaxial spray nozzles 72, 73 are employed in order to deposit pressurized cold resin adhesive 54 upon respective front and back panels of each bag 40, respectively. A conventional microprocessor-based programmable controller, including a conventional proximity sensor to detect the presence of each bag as it approaches the spray nozzles, controls the emission of adhesives through the spray nozzles, so as to deposit the alternating, collinear pattern of hot and cold adhesives, as shown in FIG. 8A.

Although, in an illustrated embodiment, adhesives are applied only to the front and back panels of bag 40, it is also contemplated that adhesives may instead or additionally be applied by spray nozzles to each handle 50 prior to its application to an associated bag 40.

Referring to FIGS. 2 and 3, each bag 40 is next driven by the conveying means between counter-rotating drum members 200 and 300. Drum member 200 has an outer surface proximate the top surface of the conveying means, while drum member 300 has an outer surface proximate the bottom surface of the conveying means. As each bag 40 is transported between the drum members, drum member 200 applies a handle 50 to the front panel of the bag, and, simultaneously, a second handle is applied to the back panel of the bag by drum member 300.

The rotational orientation and speed of each drum member is synchronized with the positioning of bags 40 upon the lug belt, adjacent lugs 61, such that each handle is applied in a substantially centered orientation relative to the width of a corresponding bag 40, attached to and juxtaposed over a handle accepting region proximate the top opening of the bag. In particular, drum members 200 and 300 share a common drive train with the conveying means, including the lug belt. A differential compensator, comprising a conventional planetary gear differential, is interposed in the drive train between the drum members and the lug belt, allowing relative adjustment of the positioning of drum members and lug belt when apparatus 10 is idle.

Figure 4:
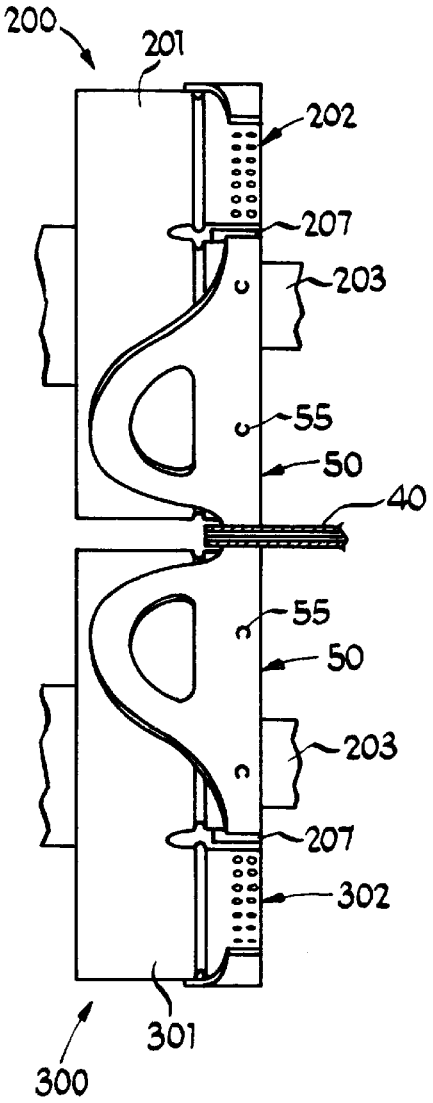
FIG. 4 of the drawings is a fragmentary, sectional view of a portion of the handle applicator apparatus, taken generally along lines 4—4 of FIG. 2 and showing, in particular, the releasable attachment of carrying handles to the outer surfaces of the drum members.

The drum members are shown in further detail in FIGS. 4–7. As shown in FIG. 4, each drum member 200, 300 includes two parallel rows of apertures 202, 302, respectively, extending about the entire circumference of the outer surface of the drum member. As explained in further detail below, as each drum member rotates, a source of vacuum pressure is periodically applied proximate the drum member, such that suction is periodically provided through apertures 202 and 302, wherein a ribbon of handle material, fed to each respective drum member, is releasably transported, or carried by the drum member. As each drum member 200, 300 rotates, an associated pair of cutting blades, such as blades 207, 209 of drum member 200 (FIGS. 5–6), cooperate with associated anvil rollers 84, 88 (FIG. 2) in order to sever the ribbons of handle material 23, 24 into individual handles 50. Each anvil roller is preferably mounted upon an eccentric bearing housing for positional adjustment relative to an associated drum member and pair of cutting blades, in order to provide adjustable cutting pressure.

The die cutting of the ribbons of handle material is synchronized with the rotational orientation of the cutting blades, such that the ribbons are severed approximately midway between adjacent handle apertures. In particular, a rotating cutting cylinder of die cutter 30 shares a common drive mechanism with that of drum members 200 and 300, such that the cutting cylinder and drum members each rotate at a common fixed speed of approximately 200 rotations per minute. Inasmuch as the drum members rotate at a tangential surface speed which is somewhat faster than the speed in which ribbons of handle material are applied to the drum members, the circumference of the die cutter's cutting cylinder is established such that it may be rotated at the same speed as the drum members. Conventional slip couplings are provided between the drum members and the cutting cylinder so that their rotational positionings may be adjusted relative to each other when bag manufacturing apparatus 10 is idle. The positioning of take-up pulleys 25 (FIG. 1) may also be adjustable, for providing further means of adjustment of the positioning of the ribbons of handles relative to the drum members.

As shown in FIG. 4, the outer surfaces of drum members 200 and 300 are preferably spaced slightly apart, in order to firmly grip each bag 40 as it is transported between the drum members. If desired, the spacing between drum members 200 and 300 may be adjustable, so as to accommodate bags 40 of varying thicknesses. Each drum member 200, 300 is driven by a corresponding shaft 203, 303, at a rotational speed of approximately 200 rotations per minute. For each drum member, two handles 50 are applied to two corresponding bags 40 upon each rotation of the drum member, corresponding to the 400 bag per minute speed of conveying means. The circumference of each drum member is approximately thirty inches, with approximately fifteen inches of surface between each cutting blade, corresponding to the approximately fifteen inch spacing between leading edges of each bag 40 within rollers 64, 65, 66 and 67 (FIGS. 2–3).

Figure 7:
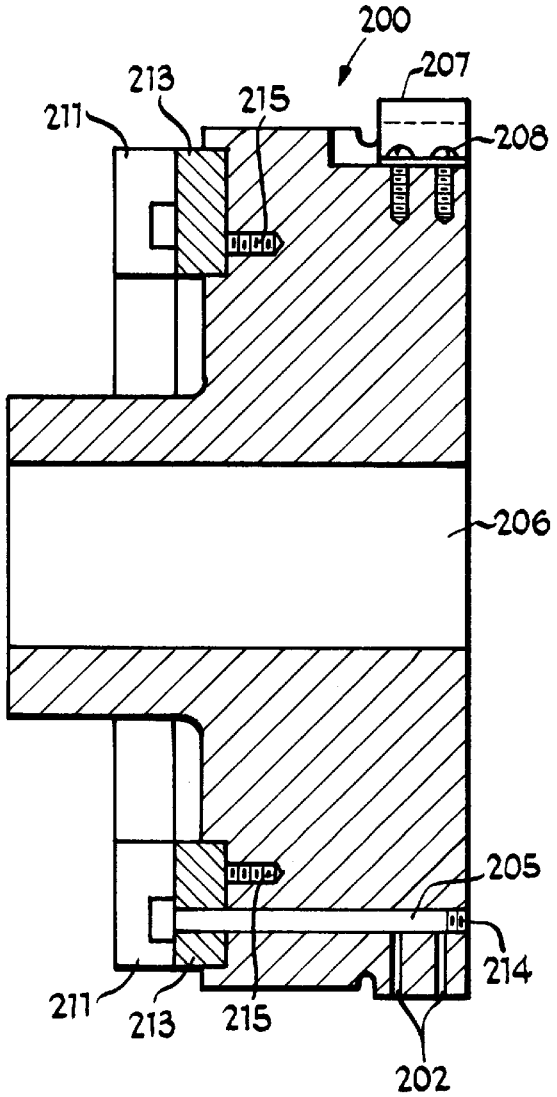
FIG. 7 of the drawings is a sectional view of the drum member of FIGS. 5 and 6, taken generally along lines 7—7 of FIG. 6.
Figure 6:
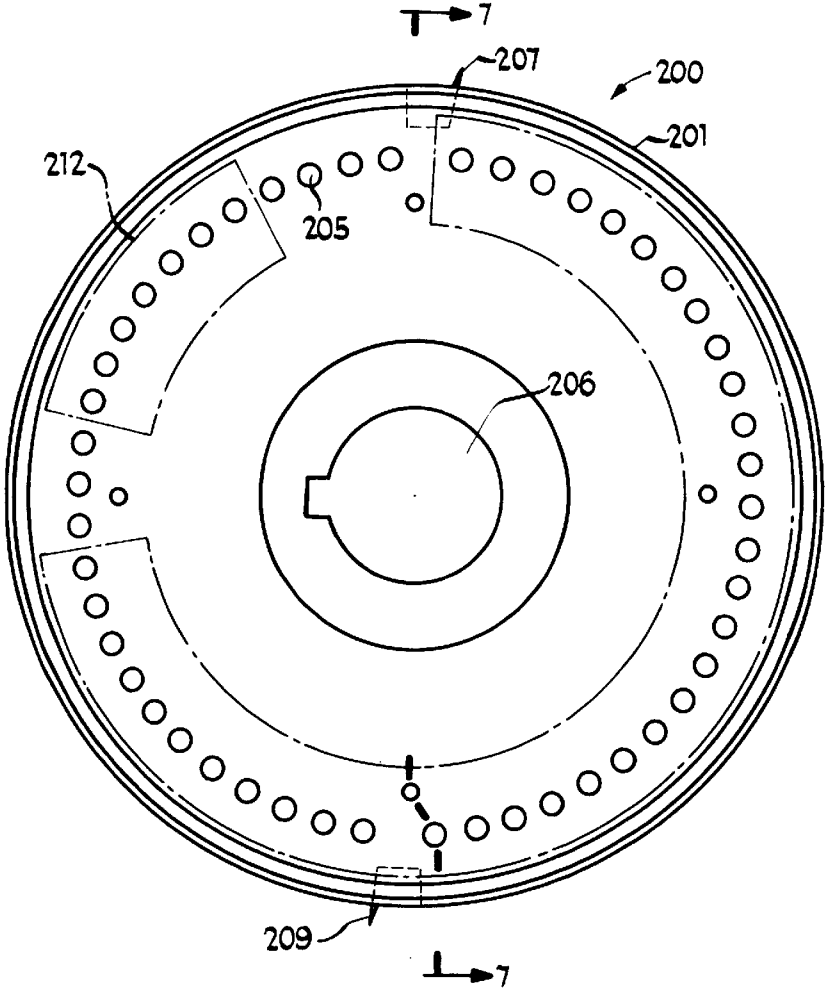
FIG. 6 of the drawings is a side elevation of an opposing side of the drum member of FIG. 5.
Figure 5:
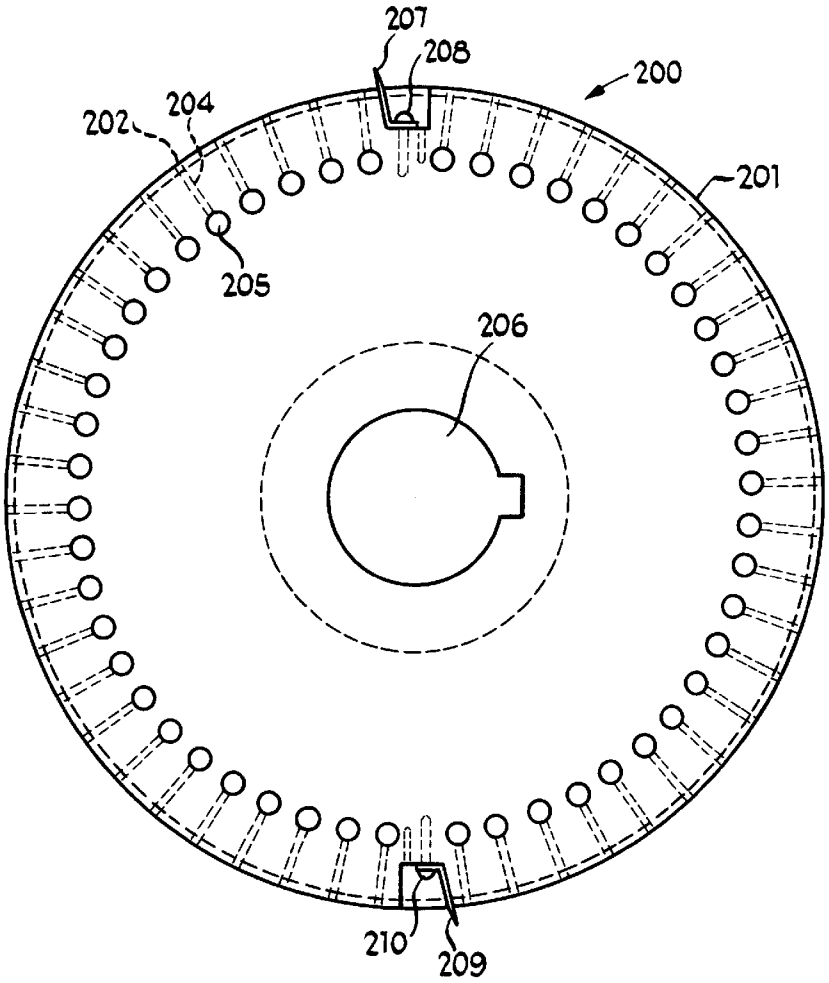
FIG. 5 of the drawings is a side elevation of one side of a drum member.

While additional details of drum member 200 are shown in FIGS. 5–7, it should be understood that these details similarly apply to drum member 300, which is substantially identical in construction to drum member 200. Referring to FIG. 5, drum member 200 includes a central bore 206 for attachment to shaft 203 (FIG. 4). Cutting blades 207, 209, are attached to the drum member within corresponding recessed slots by screws 208, 210, respectively. Cutting blades 207, 209 are separated from each other by approximately 180° of rotation relative to the center of drum member 200.

As shown in FIG. 5, each aperture 202 within the two concentric rings of apertures about the circumference of drum member 200 communicates with outer surface 201 of drum member 200, and with a corresponding transverse inner chamber 205. As shown in FIG. 7, each inner chamber 205 extends through the entire width of drum member 200. At one end, a set-screw 214 is employed to substantially seal each inner chamber 205. At its other end, each chamber 205 communicates with a corresponding chamber within bushing 213. Bushing 213 is preferably constructed from a plastic material, having a relatively low coefficient of friction. Screws 215 are employed to secure bushing 213 to drum member 200. As shown in FIGS. 6 and 7, bushing 213 contacts stationary valves 211, 212 as drum member 200 rotates. These stationary valves are also preferably constructed from a plastic material, having a relatively low coefficient of friction. A plurality of springs (not shown) are employed to bias stationary valves 211, 212 against bushing 213, so as to create a relatively air-tight seal therebetween. As shown in FIG. 6, as drum member 200 rotates, each chamber 205, via bushing 213, communicates with an interior region of stationary valve 211 for approximately 225° of its rotation. For approximately 15° of successive rotation, each chamber 205 is not in contact with any stationary valves. For approximately the next 30° of rotation, each chamber 205 is in communication with an interior region of stationary valve 212, and, finally, for the final 10° of rotation, each chamber 205 is again not in contact with any stationary valve.

A source of vacuum pressure (not shown) is continuously applied to the interior region of stationary valve 211. Moreover, a source of positive air pressure (not shown) is continuously applied to the interior region of stationary valve 212. In this manner, as each chamber 205 progresses through a complete rotation of drum member 200, it is alternatingly in communication with vacuum pressure (for 225° of rotation, via stationary valve 211), ambient pressure (for 15° of rotation), positive pressure (for 30° of rotation, via stationary valve 212) and, finally, a final 10° of no applied air pressure. Moreover, inasmuch as each aperture 202 is in communication with a corresponding chamber 205, as shown in FIG. 7, each aperture 202, and, in turn, a portion of outer surface 201 of drum member 200, is likewise alternatingly exposed to vacuum and positive pressure, in a predetermined manner, and at fixed positions relative to the instantaneous position of drum member 200 as the drum member rotates. The vacuum pressure serves to releasably affix a carrying handle upon outer surface 201 of drum member 200. The positive pressure, preferably approximately 10 to 30 pounds per square inch, serves to expel excessive adhesive, paper dust, and other debris from aperture 202.

Referring back to FIG. 2, each ribbon of handle material 23, 24 is transported to a corresponding drum member 200, 300, respectively, by a plurality of rollers. In particular, rollers 80, 81, 82 and 83 transport handle material ribbon 23 to drum member 200. Similarly, rollers 89, 85, 86 and 87 transport handle material ribbon 24 to drum member 300. Rollers 81 and 85 each include a plurality of sprocket teeth, cooperating with corresponding sprocket holes 55 (FIG. 9) within the ribbons of handle material.

Figure 10A:
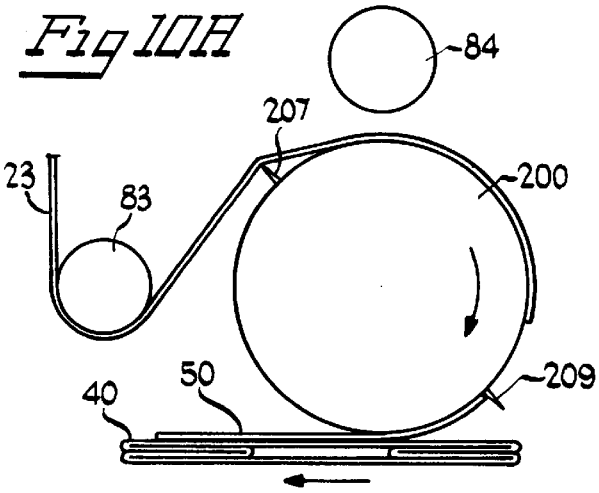
FIG. 10A of the drawings is a side elevation of a portion of the handle applicator apparatus, showing, in particular, the releasable attachment of a ribbon of handle material to the outer surface of a drum member.
Figure 10B:
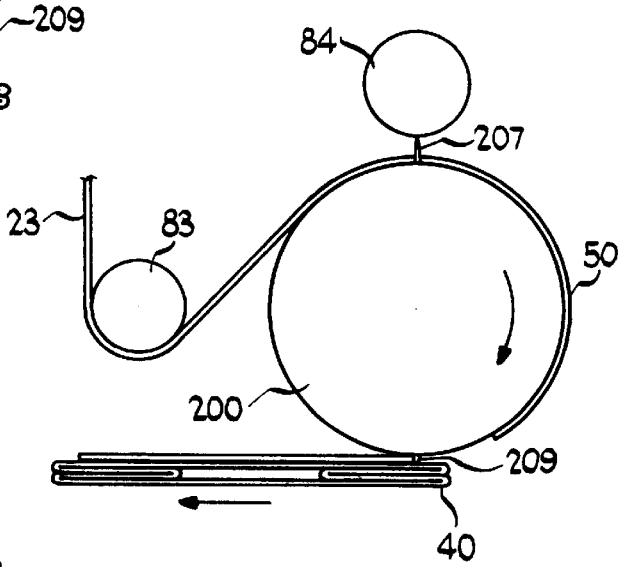
FIG. 10B of the drawings is a side elevation of the portion of the handle applicator apparatus of FIG. 10A, showing, in particular, the severing of an individual carrying handle from the continuous ribbon of handle material.
Figure 10C:
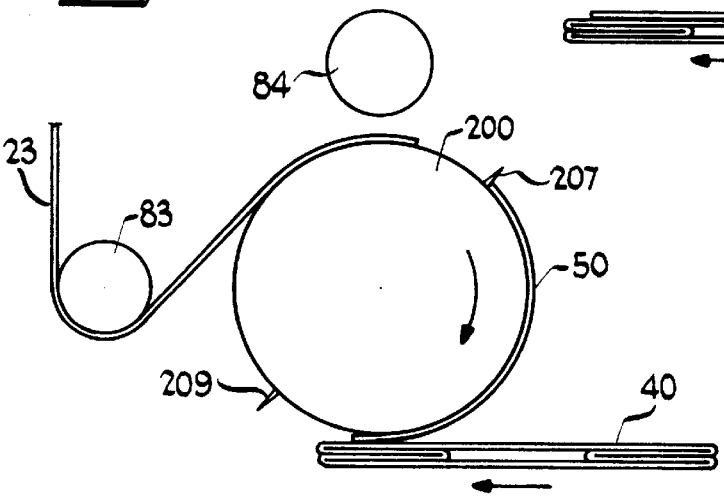
FIG. 10C of the drawings is a side elevation of the portion of the handle applicator apparatus of FIG. 10A, showing, in particular, slippage of the ribbon of handle material relative to the rotating outer surface of the roller member.

Additional details regarding the releasable transportation of handles by the drum members, the severing of the ribbon of handled into individual handles, and the application of handles to individual bags, are shown in FIGS. 10A through 10D. While FIGS. 10A–10D show additional details of these operations relative to drum member 200, it should be understood that identical operations are simultaneously occurring relative to drum member 300. Referring to FIG. 10A, as a continuous ribbon of handle material 23 is transported to drum member 200 by roller 83, it is releasably carried against the outer surface of drum member 200, held in place by vacuum pressure. A relatively light vacuum pressure of approximately ten inches of mercury nominal is employed, which is sufficient to maintain both the handle material and the severed handles adjacent drum member 200 as the drum member rotates. As shown in FIG. 10A, as drum member 200 rotates, a portion of the handle material is disposed across cutting blade 207 (or 209, depending upon the present position of the drum member), centered substantially between two adjacent handle apertures 56. Moreover, as shown in FIG. 10A, a handle 50, previously severed from the ribbon of handle material by contact between cutting blade 209 and anvil roller 84, is being affixed to a bag 40. As shown in FIG. 10B, as cutting blade 207 reaches a vertical orientation, at approximately 0° of drum member orientation, cutting blade 207 contacts anvil roller 84, severing an individual handle 50 from the leading edge continuous ribbon of handle material 23. Next, as shown in FIG. 10C, and as drum member 200 further rotates, the remaining portion of handle material ribbon 23 separates slightly from cutting blade 207, as the leading edge of the ribbon slips slightly upon the outer surface of drum member 200. This slippage continuously occurs between handle material ribbon 23 and the outer surface of drum member 200 until an individual handle 50 is severed from the ribbon, inasmuch as the rotational speed of drum member 200 is slightly faster than the supply speed of handle material ribbon 23 via roller 83. In the illustrated embodiment, the attachment panel portion of each handle 50 is approximately nine inches in length, yielding an overall slippage of approximately three inches within the fifteen inches of circumference about the outer surface of drum member 200 between cutting blades 207 and 209.

Figure 10D:
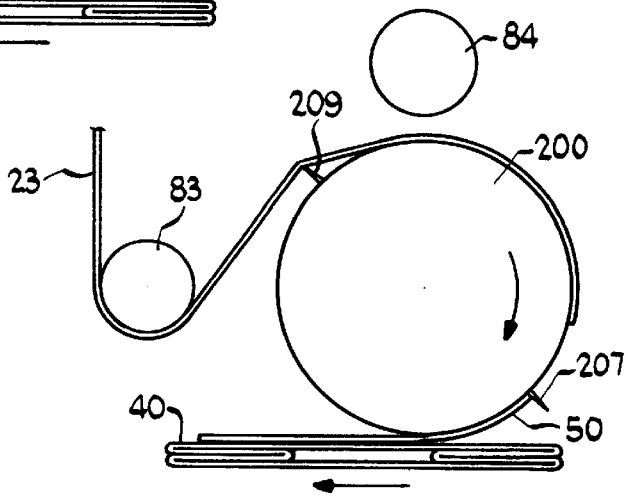
FIG. 10D of the drawings is a side elevation of the portion of the handle applicator apparatus of FIG. 10A, showing, in particular, the attachment of a carrying handle to a bag.

Moreover, as further shown in FIG. 10C, a leading edge of a severed carrying handle 50 comes into contact with bag 40, and the adhesive previously disposed upon a handle accepting region of bag 40 serves to draw the handle 50 away from drum member 200 and into attachment to bag 40. The vacuum pressure previously holding the severed carrying handle against the outer surface of the drum member is released at approximately 180° orientation from vertical, permitting separation of the carrying handle from the drum member. As shown in FIG. 10D, drum member 200 has gone through 180° of rotation, relative to FIG. 10A, and is ready to sever an additional handle for application to a successive bag 40. In this manner, each drum member applies two carrying handles to two successive bags for each 360° rotation of the drum member.

Each drum member accordingly provides a means for transporting a carrying handle proximate a front or a back panel of a bag, in a direction of travel wherein, as referenced from 180° from vertical, the longitudinal axis of the carrying handle is substantially parallel to the direction of travel of the bag, and substantially perpendicular to the longitudinal axis of the bag, at a tangential velocity substantially equal to the velocity of the bag.

Although, in the illustrated embodiment, drum members having a 30-inch circumference are employed for attaching two handles per complete rotation (i.e., a 2-stage unit), other configurations are also contemplated. For example, a 15-inch single-stage drum member may be employed, attaching one handle per complete rotation. Alternatively, a 45-inch 3-stage drum member may be employed, attaching three handles per complete rotation. Of course, varying the number of handles applied per drum member rotation necessitates not only varying the circumference of the drum member, but also its rotational speed and number of cutting blades, spaced equally about the drum member's circumference.

Referring again to FIGS. 2 and 3, following the application of handles 50 to the front and back surfaces of each bag 40 by the drum members, each handle 50 is scored and folded, so that each handle resides within the overall "outline" of the outer surfaces of its corresponding bag 40. As shown in FIGS. 2–3, following application of the handles, each bag is conveyed past counter-rotating pairs of pinch rollers 90, scoring wheels 91, pinch rollers 92, and an additional pair of scoring wheels 93. Each pair of scoring wheels 91, 93 comprises a conventional male scoring wheel, having an annular projection, and a conventional female scoring wheel, having a corresponding annular groove. Scoring wheels 91 are employed in order to score the carrying handle applied to the front surface of bag 40, creating a score line along the length of the handle, parallel to the longitudinal axis and proximate the junction of the attachment panel portion and the grasping portion. Scoring wheels 92 provide a similar score line along the length of the carrying handle applied to the back panel of bag 40.

Meanwhile, pinch rollers 90, 92 serve to enhance attachment of the carrying handles to the bag, by compressing the carrying handles towards the bag when the handle accepting regions of the bag and the attachment panel portions of the carrying handles pass between the counter-rotating pinch rollers.

Next, as shown in FIG. 3, two plows 94, each comprising a substantially thin piece of material, such as sheet metal, are each employed to fold a corresponding handle 50 about its respective score line. As each bag 40 is driven between the two plows by the conveying means, contact between the grasping portion of each handle and an associated plow, and the angled construction of the edge of the plow facing the conveyor, serve to push and fold the handle 50 over, with the grasping portion proximate the bag surface. Next, as shown in FIG. 3, a pair of pinch rollers 68 serve to complete the folding process, by pressing the folded handle proximate the corresponding surface of bag 40. The application and folding of handles to bag 40 is now complete, and the handled bags 40 may be removed from the conveyor and packaged for shipping.

It is also contemplated that the present invention be employed to attach handles to a continuous web of material from which individual bags are subsequently severed and formed. In this embodiment, bag turning apparatus 35 (FIG. 1) is not required, inasmuch as individual bags are not yet formed at the time handles are applied to the web of bag material by handle applicator 100. In this embodiment, handle cutter 100 and die cutter 30 operate in a similar manner as that disclosed in the previous embodiment with respect to the application of handles to individual bags. This embodiment differs from the previously-described embodiments primarily in that conveying means 60 transports an elongated, continuous web of bag material, rather than individual bags, through the handle applicator apparatus, between the drum members. The continuous web is transported by the conveying means at a predetermined velocity, and with the longitudinal axis of the subsequently formed bags substantially perpendicular to the direction of travel of the web. The drum members sever individual handles from continuous ribbons of handle material, as previously described. The severed handles are transported by the drum member proximate a portion of the continuous web which corresponds to front or back panels of the bag which will be subsequently formed, following attachment of the handles. The severed carrying handles are transported by the drums in a direction of travel wherein the longitudinal axis of the carrying handle is parallel to the direction of travel of the continuous web of handle material, and perpendicular to the longitudinal axis of the bag which will be subsequently formed. The velocity of the severed handles is again substantially equal to the predetermined velocity of the continuous web. An adhesive is again applied to at least one of the elongated attachment panel portion of the carrying handle, and a handle accepting region of the continuous web, proximate what will become a top portion of a front or back panel of the bag, when the bag is subsequently cut and formed from the continuous web.

In one embodiment, the continuous web may comprise two vertically-stacked sheets of plastic material, which are subsequently formed into individual bags by heat sealing regularly-spaced portions of the web, and severing the web within the heat-sealed regions, so as to create two-sided plastic bags. In this embodiment, handle apparatus 100 preferably attaches two handles simultaneously to both the upper and lower vertically stacked sheets of the continuous plastic web.

In another embodiment, the continuous web is constructed of a single sheet of paper material, which is subsequently severed and folded into individual bags. In this embodiment, handles are preferably only applied to the top surface of the continuous web of paper material. Sections of the continuous web, which are subsequently severed in order to form a bag, include two coaxial handles attached thereto: one attached to what will become the front panel of the bag, and one attached to what will become the back panel of the bag, following the folding and final formation of the bag.

Following attachment of handles to a continuous web of bag material, the handles may be scored and folded, in the manner previously described. This folding of the handles may occur either before or after the bags are severed from the web, towards formation of individual handled bags.

Although, in an illustrated embodiment, the present apparatus is employed to apply handles to bags, or to continuous webs from which bags are subsequently formed. other applications are also contemplated. For example, the continuous web of handle material may be replaced with a continuous web of bag stiffener material, which may be applied to bags by the drum members. Moreover, the present apparatus may be readily modified to apply what is commonly known as a "peel-and-seal" strip to a container, such as envelopes used by express courier services.

The foregoing description and drawings merely explain and illustrate the invention and the invention is not limited thereto, except insofar as the appended claims are so limited, as those skilled in the who have the disclosure before them will be able to make modifications and variations therein without departing from the scope of the invention.

We claim:

1. An apparatus for attaching a plurality of carrying handles to a plurality of at least partially formed bags, completely severed from a web of bag material, so that at least one carrying handle is applied to each of said bags, each said bag having a front panel, a back panel, a bottom end, a top end having an opening into an interior region of said bag, and a longitudinal bag axis intersecting said top and bottom ends of said bag, each of said one or more carrying handles having an elongated attachment panel portion, a longitudinal handle axis extending along said elongated attachment panel portion, and a grasping portion coupled to said attachment panel, said apparatus comprising:

a supply of a plurality of at least partially formed bags completely severed from a web of bag material, each bag having a front panel, a back panel, a bottom end, a top end having an opening into an interior region of said bag, and a longitudinal bag axis intersecting said top and bottom ends of said bag;

a supply of a plurality of substantially preformed carrying handles, each substantially preformed carrying handle having an elongated attachment panel portion, a longitudinal handle axis extending along said elongated attachment panel portion, and a grasping portion coupled to said attachment panel, said supply of a plurality of carrying handles including an elongated, substantially continuous web of conjoined substantially preformed carrying handle elements, for delivery in substantially continuous motion;

means for conveying each of said bags, in substantially continuous movement, at a predetermined velocity and with said longitudinal bag axis substantially perpendicular to a direction of travel of said bag;

a web separator for separating said web of conjoined substantially preformed carrying handle elements into distinct, completely formed carrying handle elements;

means for transporting at least one of said carrying handle elements proximate to at least one of said front and back panels of each of said bags, in said direction of travel of said bag, wherein said longitudinal handle axis of said carrying handle element is substantially parallel to said direction of travel of said bag and substantially perpendicular to said longitudinal bag axis, at a velocity substantially equal to said predetermined velocity of said bag; and means for attaching said at least one of said carrying handle elements to a handle accepting region of each of said bags, said at least one of said carrying handle elements being applied to said at least one of said front and back panels of each of said bags when each of said bags is transported by said conveying means to a position wherein said handle accepting region of each of said bags contacts said attachment panel portion of said at least one of said carrying handle elements, said at least one of said carrying handle elements being affixed to said bag with said attachment panel portion attached to and juxtaposed over said handle accepting region of each of said bags.

2. The apparatus according to claim 1 wherein said conveying means has an upper surface and wherein said means for transporting said at least one of said carrying handle elements includes at least one drum member having an axis of rotation substantially perpendicular to said direction of travel of said bags and having an outer surface proximate at least a portion of one of said upper and lower surfaces of said conveying means, said at least one drum member including means for releasably transporting at least one carrying handle element substantially adjacent said outer surface, at a tangential velocity substantially equal to said predetermined velocity of said bags.

3. The apparatus according to claim 2 wherein said means for releasably transporting said at least one carrying handle element substantially adjacent said outer surface of said at least one drum member comprises:

at least one aperture extending through and rotating with said outer surface of said at least one drum member, said aperture communicating with a source of vacuum pressure, serving to draw air through said aperture to, in turn, transiently affix a portion of said at least one carrying handle element overlying said aperture to said outer surface of said at least one drum member.

4. The apparatus according to claim 3 wherein said source of vacuum pressure is fixed in position relative to said rotation of said at least one drum member, said source of vacuum pressure being applied proximate said at least one drum member and limited to a portion of a circumference of said at least one drum member such that as said at least one drum member rotates, said vacuum pressure being alternatingly applied to and removed from said aperture, wherein said portion of said at least one carrying handle element overlying said aperture is affixed to said outer surface of said at least one drum member when said aperture is exposed to said vacuum pressure, said apparatus further comprising:

means for limiting said vacuum pressure to only a portion of a circumference of said at least one drum member; and means for alternatingly applying vacuum pressure to and removing vacuum pressure from said aperture.

5. The apparatus according to claim 2 wherein said apparatus further includes:

a continuous web of successive ones of said substantially preformed carrying handle elements, each of said carrying handle elements being substantially collinear and attached to each other along said continuous web, said continuous web including a leading edge applied to and releasably transported by said at least one drum member; and a cutter member for cutting at least one complete carrying handle from said continuous web of successive ones of said one or more substantially preformed carrying handles.

6. The apparatus according to claim 5 wherein said continuous web of carrying handle elements is constructed from a substantially plastic material.

7. The apparatus according to claim 5 wherein said apparatus further includes means for cutting said continuous web of handles into individual handles.

8. The apparatus according to claim 7 wherein at least a portion of said handle cutting means is operably attached to said outer surface of said at least one drum member.

9. The apparatus according to claim 1 wherein said attaching means comprises means for depositing adhesive upon at least one of said elongated attachment panel portion of said bag and a handle accepting region of at least one of said front and back panels of said bag.

10. The apparatus according to claim 9 wherein said adhesive comprises an alternating sequence of hot melt and cold resin adhesives, said means for depositing adhesive further comprising:

means for applying, in an alternating sequence, hot melt and cold resin adhesives.

11. The apparatus according to claim 10 wherein said hot melt adhesive comprises a substantially wax-based adhesive, and said cold resin adhesive comprises a substantially polyvinyl acetate type adhesive.

12. The apparatus according to claim 1 wherein said bag is constructed from a substantially paper material.

13. The apparatus according to claim 1 wherein said apparatus further includes means for enhancing said attachment of at least one of said carrying handle elements to said bag by compressing a carrying handle element and said bag towards each other.

14. The apparatus according to claim 13 wherein said attachment enhancing means comprise a plurality of pinch rollers, said conveying means transporting said at least a portion of said bag between said pinch rollers such that at least a portion of said at least one handle accepting region of said bag and said attachment panel portion of at least one of said carrying handle elements are momentarily disposed between said pinch rollers.

15. The apparatus according to claim 1 wherein said apparatus further includes means for folding said at least one grasping portion of at least one of said carrying handle elements, along a fold line extending substantially parallel to said longitudinal handle axis, towards said attachment panel portion following said attachment of said at least one of said carrying handle elements to said bag.

16. The apparatus according to claim 15 wherein said folding means includes:

means for scoring at least one of said carrying handle elements so as to form said longitudinal fold line, extending substantially parallel to said longitudinal handle axis; and means for moving said grasping portion towards said attachment panel portion, such that said at least one carrying handle element is folded proximate said longitudinal fold line.

17. The apparatus according to claim 1 wherein said plurality of carrying handles comprises a first carrying handle and a second carrying handle on each of said bags and said means for transporting said at least one of said carrying handle elements comprises means for transporting a first carrying handle element proximate said front panel of said bag, and means for transporting a second carrying handle element proximate said back panel of said bag; and said attachment means comprises means for attaching said first carrying handle element to a first handle accepting region of said front panel of said bag, and means for attaching said second carrying handle element to a second handle accepting region of said back panel of said bag, said first carrying handle element being applied to said front panel of said bag and said second carrying handle element being applied to said back panel of said bag when said bag is transported by said conveying means to a position wherein said first and second handle accepting regions of said bag contact said attachment panel portions of said first and second carrying handle elements, respectively, said first and second carrying handle elements being applied to said bag with said attachment panel portions attached to and juxtaposed over said handle accepting regions of said bag.

18. The apparatus according to claim 17 wherein said apparatus further includes:

a supply of a continuous web of handle material; and means for receiving said continuous web of handle material and for cutting said continuous web of handle material into two continuous ribbons of handles, including a first ribbon of handles and a second ribbon of handles, said first ribbon of handles being severed into individual handles and applied to said front panels of said bags, and said second ribbon of handles being severed into individual handles and applied to said back panels of said bags.

19. A method for attaching at least one carrying handle to a bag, said method comprising the steps of:

providing a a supply of at least partially formed bags completely severed from a web of bag material, each said bag having a front panel, a back panel, a bottom end, a top end having an opening into an interior region of said bag, and a longitudinal bag axis intersecting said top and bottom ends of said bag;

providing a supply of plurality of substantially preformed carrying handles, each said carrying handle having an elongated attachment panel portion, a longitudinal handle axis extending along said elongated attachment panel portion, and a grasping portion coupled to said attachment panel portion;

said supply of a plurality of substantially preformed carrying handles including an elongated, substantially continuous web of conjoined substantially preformed carrying handle elements, for delivery in substantially continuous motion;

transporting said bags, in substantially continuous movement, along a conveyor at a predetermined velocity and with said longitudinal bag axis substantially perpendicular to a direction of travel of said bag, said conveyor having an upper surface and a lower surface;

separating said web of conjoined substantially preformed carrying handle elements into distinct, completely formed carrying handle elements;

transporting at least one of said carrying handle elements proximate at least one of said front and back panels of each of said bags, in a direction of travel wherein said longitudinal handle axis is substantially parallel to said direction of travel of each of said bags and substantially perpendicular to said longitudinal bag axis, at a velocity substantially equal to said predetermined velocity of said bag;

applying at least one of said carrying handle elements to one of said front and back panels of each of said bags when said bags are transported by said conveyor to a position wherein a handle accepting region of each of said bags contacts said attachment panel portion of said carrying handle elements; and attaching said at least one of said carrying handle elements to each of said bags and with said attachment panel portion of said carrying handle attached to and juxtaposed over said handle accepting region of each of said bags.

* * * * *